US011304517B2

(12) United States Patent
Trombettoni et al.

(10) Patent No.: US 11,304,517 B2
(45) Date of Patent: Apr. 19, 2022

(54) CABINET WITH PULL-OUT SHELVES AND RELATED PULL-OUT MECHANISM WITH IMPROVED GUIDE

(71) Applicant: INOXA SRL, Polverigi (IT)

(72) Inventors: Roberto Trombettoni, Polverigi (IT); Emanuele Silvi, Polverigi (IT)

( * ) Notice: Subject to any disclaimer, the term of this patent is extended or adjusted under 35 U.S.C. 154(b) by 0 days.

(21) Appl. No.: 16/753,785

(22) PCT Filed: Oct. 4, 2018

(86) PCT No.: PCT/IT2018/050184

§ 371 (c)(1),
(2) Date: Apr. 5, 2020

(87) PCT Pub. No.: WO2019/069339

PCT Pub. Date: Apr. 11, 2019

(65) Prior Publication Data

US 2020/0253376 A1 Aug. 13, 2020

(30) Foreign Application Priority Data

Oct. 6, 2017 (IT) ..... 202017000112723

(51) Int. Cl.
*A47B 81/00* (2006.01)
*A47B 88/90* (2017.01)
*A47B 49/00* (2006.01)

(52) U.S. Cl.
CPC ..... *A47B 81/002* (2013.01); *A47B 49/006* (2013.01); *A47B 88/90* (2017.01)

(58) Field of Classification Search
CPC ..... A47B 81/002; A47B 88/90; A47B 49/006
(Continued)

(56) References Cited

U.S. PATENT DOCUMENTS 5,752,756 A * 5/1998 Compagnucci ..... A47B 49/004 312/238
7,318,631 B2 * 1/2008 Kreyenkamp ..... A47B 81/002 312/238

(Continued)

FOREIGN PATENT DOCUMENTS

AT 481896 T 10/2010
CN 205135331 U 4/2016

(Continued)

OTHER PUBLICATIONS

ISR; European Patent Office; NL; dated Jan. 21, 2019.

(Continued)

*Primary Examiner* — Daniel J Troy
*Assistant Examiner* — Timothy M Ayres
(74) *Attorney, Agent, or Firm* — Patshegen IP LLC; Moshe Pinchas

(57) ABSTRACT

A cabinet (1) with a containment space (2), shelves (9) contained in the containment space (2), an access opening (3) to the containment space (2) and a moving mechanism (4) for moving the shelves (9) through said opening (3); wherein said moving mechanism (4) comprises a first arm (5) and a second arm (6), which are sustained by the cabinet (1), cantilever-style, inside the containment space (2), and rotatably about a vertical line (V), said first arm (5) and second arm (6) in turn sustaining a related shelf (9) in a condition in which it can rotate, turning about at least one vertical line (V); at least the second arm (6) of said arms (5, 6) being provided with two component segments (10, 11), converging at an interposed articulated joint (12); and control and guiding means (13) for coordination of the movement of said first arm (5) and second arm (6) which are designed to allow the shelf (9) to travel along a horizontal trajectory with variable orientation of its positioning, in such a way as to pass through the access opening (3) of said (Continued)

cabinet (1). The control and guiding means (13) comprise a double slider (14) and a double track (16) relative to which said double slider (14) is movable, said sliders (14) and said tracks (16) being constantly coupled to one another, and operatively positioned between said first arm (5) and second arm (6).

8 Claims, 4 Drawing Sheets

(58) Field of Classification Search
USPC ..... 312/249.2
See application file for complete search history.

(56) References Cited

U.S. PATENT DOCUMENTS 8,020,951 B2 * 9/2011 Twellmann ..... A47B 81/002 312/238
10,092,094 B2 * 10/2018 Sagel ..... A47B 81/002
2011/0193455 A1 * 8/2011 Kreyenkamp ..... A47B 81/002 312/238

FOREIGN PATENT DOCUMENTS

| | | | | |
|---|---|---|---|---|
| DE | 202007010283 | U1 | | 3/2008 |
| EP | 2 092 850 | | * | 8/2009 |
| EP | 2092850 | A1 | | 8/2009 |
| EP | 2092850 | B1 | | 9/2010 |
| EP | 2353438 | A2 | | 8/2011 |
| IT | UB20161157 | A1 | | 8/2017 |
| WO | 2017149556 | A1 | | 9/2017 |

OTHER PUBLICATIONS

Intellectual Property India, Examination Report; dated Mar. 16, 2021.
Official Action of CN2018800703234; dated Oct. 6, 2021.

* cited by examiner

CABINET WITH PULL-OUT SHELVES AND RELATED PULL-OUT MECHANISM WITH IMPROVED GUIDE

TECHNICAL FIELD

This invention relates to a cabinet with shelves that can be pulled out of a containment space and related pull-out mechanism with improved guide.

BACKGROUND ART

When constructing furniture and in particular corner cabinets, which may have a modular structure, a known method for solving the problem of poor access to the inner compartment of the furniture through its door is to make the shelves such that they can be pulled out for use and then put back into the compartment with a reverse movement.

In fact, that allows the user to access and use the shelf in total comfort, without encountering any obstacles, and then put the shelf, along with the objects supported, back in the containment space inside the piece of furniture when he or she has finished handling the objects.

The movements of pulling out and putting back in the shelf through the access opening of the piece of furniture affect both the shape of the outline of the shelf and the trajectory that the shelf has to follow in order to: come out of the containment space of the piece of furniture; reach the outside of the piece of furniture; and go back into it during the reverse movement. In terms of shape, semi-circular shelves have proved able to provide a satisfactory compromise between usable surface and transit without obstacles through the access opening of the piece of furniture.

One prior art solution proposed by the same Applicant and described in document IT 102017000069780 presents a solution provided with a track having an essentially sinusoidal, two-lobe shape, basically defined by two consecutive arcs which are substantially semi-circular in opposite directions, which are closed at the opposite ends of the track. The pull-out shelf is moved by a control mechanism (for shelf movement) which essentially comprises a slider which is moved forward and backward along the track—with a suitable law of motion implemented within the geometric shape of the track—as well as between the closed ends of the track which prevent the slider from being able to release itself from the track.

That solution, although achieving significant advantages in particular with reference to simplification of the moving mechanism for the pull-out shelves, is susceptible to further improvement.

DISCLOSURE OF THE INVENTION

Within the scope of that technical purpose a first aim of the invention relates to the search for a moving mechanism which allows a very regular and repeatable sliding of the sliding parts even after a very prolonged period of use.

A second aim is the search for a high level of structural rigidity of the components which guarantees that the movable component parts will not accidentally be released even following any accentuated deformability induced by a high overloading of the object holding shelf.

BRIEF DESCRIPTION OF THE DRAWINGS

The advantages of the invention are more apparent in the detailed description which follows, with reference to the accompanying drawings which illustrate an example, non-limiting embodiment of the invention, in which.

DETAILED DESCRIPTION OF PREFERRED EMBODIMENT OF THE INVENTION

Figure 1:
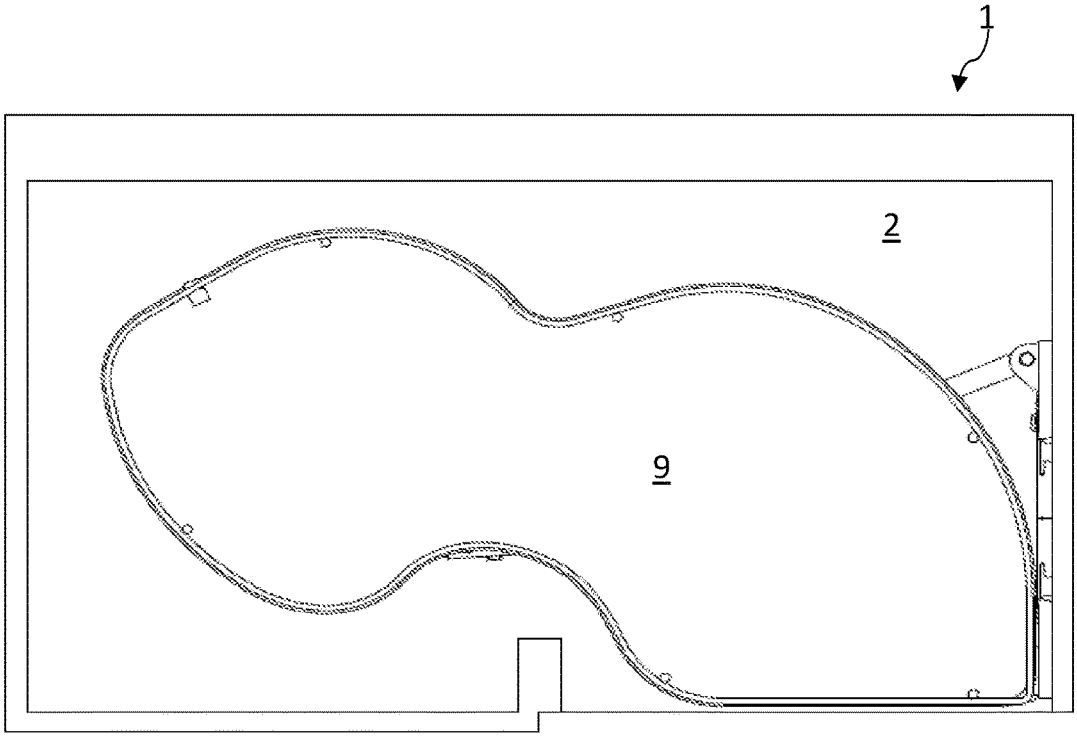
FIG. 1 is a top plan assembly view of the invention, illustrated with a pull-out shelf completely contained in the containment space of a generic cabinet.
Figure 2:
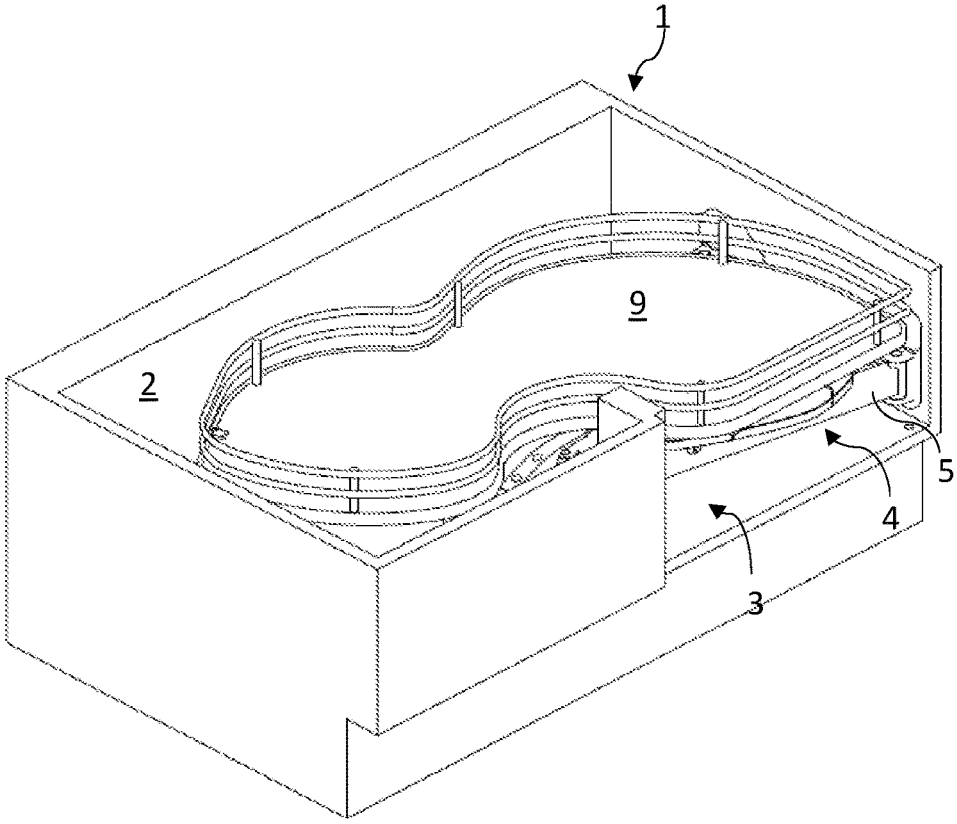
FIG. 2 is a perspective assembly view of the invention of FIG. 1.
Figure 3:
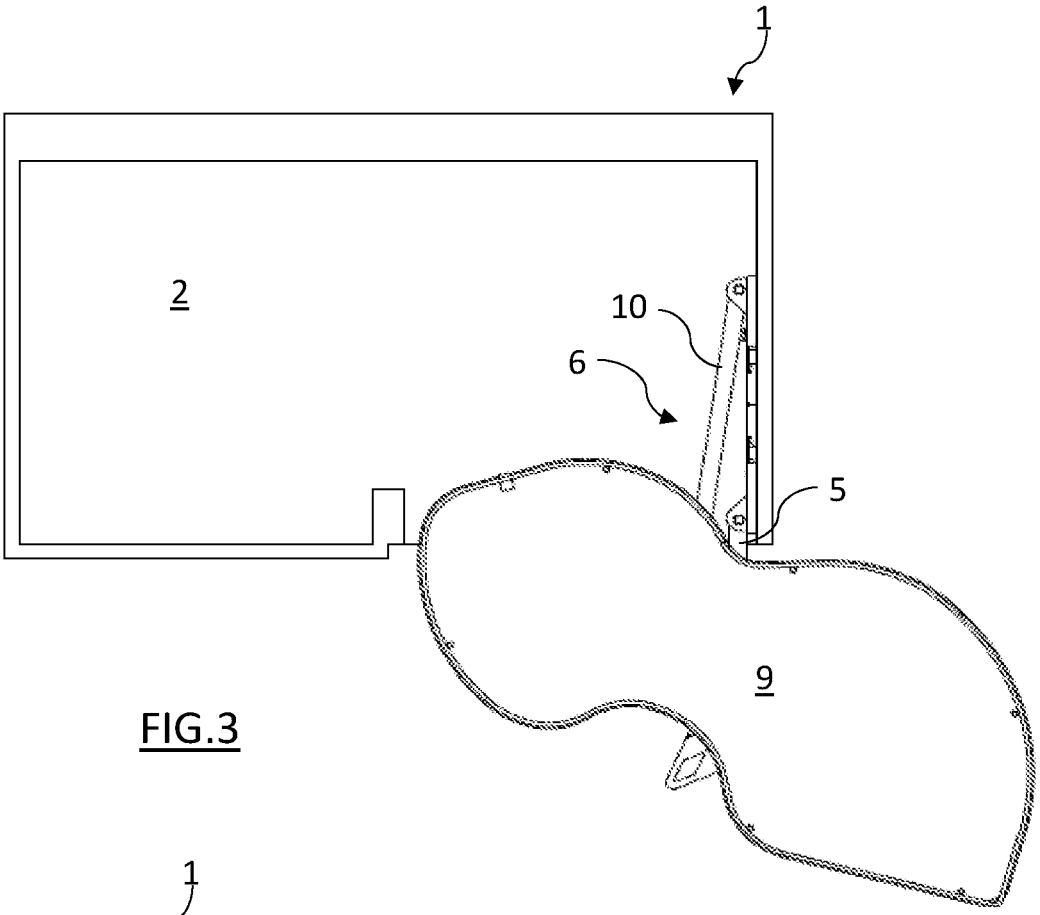
FIG. 3 is a top plan view showing the shelf and the related pull-out mechanism extracted from the cabinet.
Figure 4:
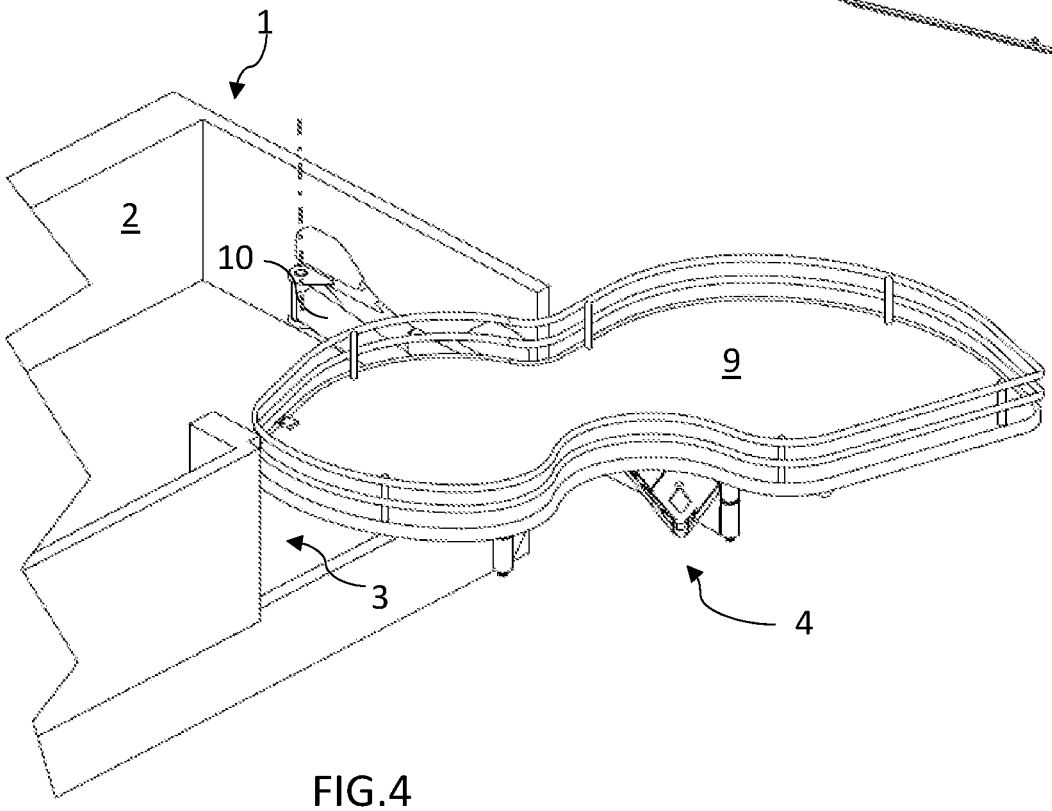
FIG. 4 is a perspective assembly view of the invention shown in FIG. 3.

With reference to FIGS. 1 to 4 of the accompanying drawings, the numeral 1 denotes in its entirety a generic cabinet provided with a containment space 2 equipped with horizontal shelves 9 for supporting objects and a moving mechanism for the shelf 9. That moving mechanism 4 comprises a first arm 5 and a second arm 6, which are also sustained by the cabinet 1, cantilever-style, and able to rotate about a vertical line V.

The arms 5, 6 in turn sustain a shelf 9, which is also rotatable about a vertical line V and in particular the second arm 6 is provided with two component segments 10, 11, converging at an interposed articulated joint 12. The coordination of the movement of the above-mentioned arms 5, 6 is designed to allow the shelf 9 to travel along a horizontal trajectory with variable orientation of its positioning, in such a way as to pass through the access opening 3 of the cabinet 1.

Figure 5:
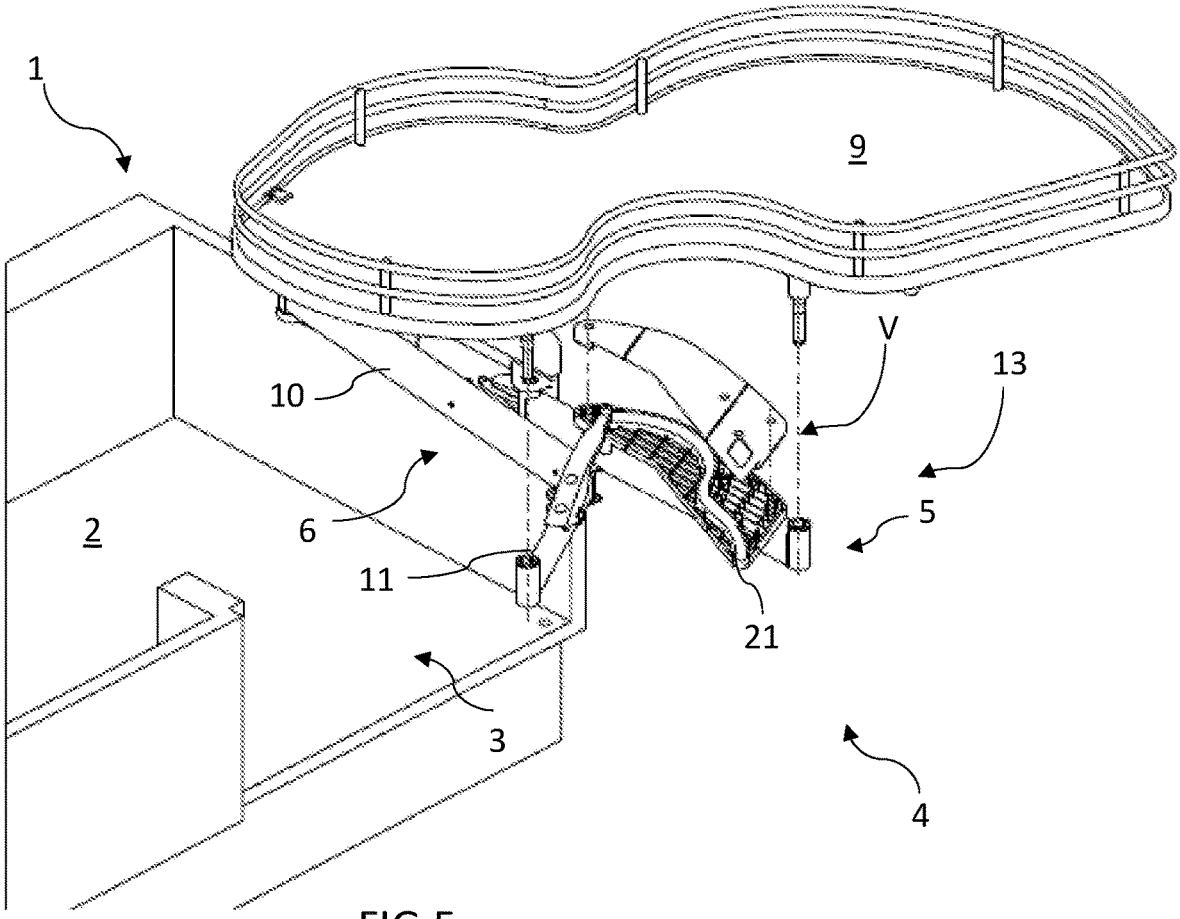
FIG. 5 is an exploded perspective view of the invention.
Figure 6:
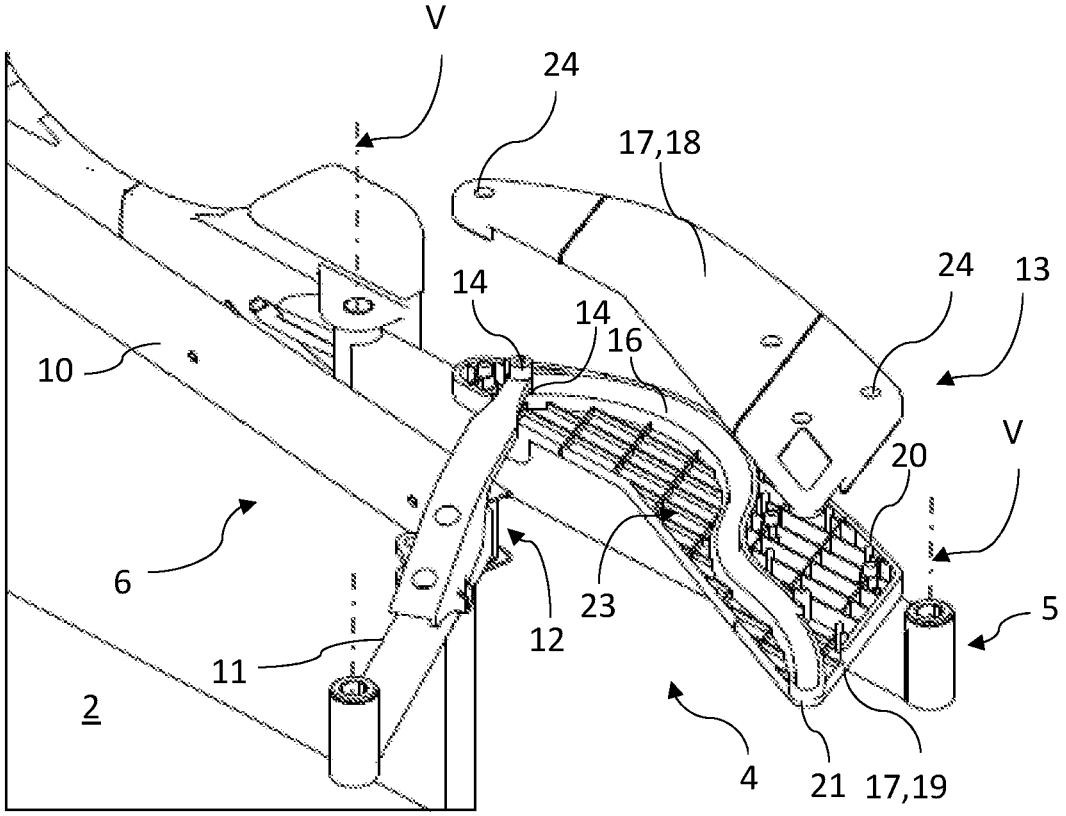
FIGS. 6 and 7 are partial perspective views and with some parts cut away, of the invention, foreshortened, respectively from the top and the bottom.
Figure 7:
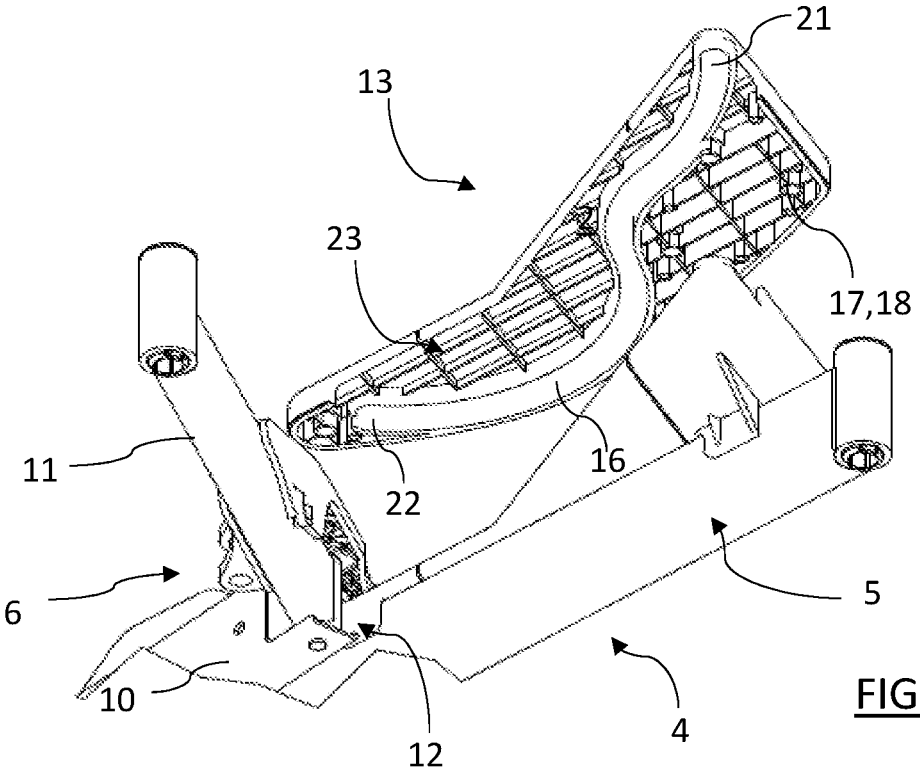

In particular (FIG. 5) the control and guiding means 13 comprise a movable double slider 14 and a double track 16 which are constantly coupled to one another and operatively positioned between the above-mentioned first arm 5 and second arm 6 (FIGS. 6 to 7).

In particular, as shown in FIGS. 5 to 7, each of the tracks 16 is supported by a corresponding plate 17 or half-shell 18. The plates 17 preferably extend in a relatively large horizontal plane 20. Their thickness is such that it covers the entire height extent of the corresponding track 16; moreover each plate 17 is stiffened by a dense trellis-style set of fins 23 which further increases their structural rigidity.

The double sliders 14 are coaxial and connected to each other in a single body as well as being interposed between two said tracks 16, which are on either side and opposite one another.

The two opposite plates 16 may be monolithically connected to each other by screws (not shown) engaged in seats which are shaped to match them and are labelled 24.

The invention fulfils the stated aims. In fact, the presence of a double plate 17 in which double sliders 14 engaged in a double track 16 operate allows, all conditions being equal, halving of the contact pressure between the movable parts, with a consequent increase in the working lifetime of the invention.

Moreover, the high level of rigidity of the control and guiding means 13 means that the movement is extremely regular and repeatable under any shelf 9 load condition, also guaranteeing that the sliders 14 and the related tracks 16 are not accidentally released from each other. The invention described above is susceptible of evident industrial application. It may also be modified and adapted in several ways without thereby departing from the scope of the following claims. Moreover, all details of the invention may be substituted by technically equivalent elements.

The invention claimed is:

1. A cabinet with a containment space (2), shelves (9) contained in the containment space (2), an access opening (3) to the containment space (2) and a moving mechanism (4) for moving the shelves (9) through said opening (3); wherein said moving mechanism (4) comprises a first arm (5) and a second arm (6), which are cantilever sustained by the cabinet (1), inside the containment space (2), and rotatably about a vertical line (V), said first arm (5) and second arm (6) in turn sustaining a related shelf (9) in a condition in which it can rotate, turning about at least one vertical line (V); at least the second arm (6) of said arms (5, 6) being provided with two component segments (10, 11), converging at an interposed articulated joint (12); and control and guiding means (13) for coordination of the movement of said first arm (5) and second arm (6) which are designed to allow the shelf (9) to travel along a horizontal trajectory with variable orientation of its positioning, in such a way as to pass through the access opening (3) of said cabinet (1); wherein said control and guiding means (13) comprise two sliders (14) and two tracks (16) relative to which said sliders (14) are movable, said sliders (14) and said tracks (16) being constantly coupled to one another, and operatively positioned between said first arm (5) and second arm (6); and wherein said sliders (14) are coaxial and monolithically connected to each other, being interposed between said two tracks (16) which are on either side and opposite one another.

2. The cabinet (1), according to claim 1, wherein at least one of said tracks (16) is supported by a plate (17).

3. The cabinet (1), according to claim 1, wherein said tracks (16) are respectively supported by one of said plates (17) which extends essentially horizontally.

4. The cabinet (1), according to claim 1, wherein said plates (15) are in the shape of two half-shells (18, 19) which are opposite one another and on either side of an ideal horizontal plane (20).

5. The cabinet (1), according to claim claim 4, wherein said two half-shells (18, 19) are rigidly and monolithically connected to each other.

6. A moving mechanism for moving shelves (9) which can be pulled out of a cabinet (1) which comprises a containment space (2), shelves (9) contained in the containment space (2), an access opening (3) to the containment space (2); wherein said moving mechanism (4) comprises a first arm (5) and a second arm (6), which are cantilever sustained by the cabinet (1), inside the containment space (2), and rotatably about a vertical line (V), said first arm (5) and second arm (6) in turn sustaining a related shelf (9) in a condition in which it can rotate, turning about at least one vertical line (V); at least the second arm (6) of said arms (5, 6) being provided with two component segments (10, 11), converging at an interposed articulated joint (12); and control and guiding means (13) for coordination of the movement of said first arm (5) and second arm (6) which are designed to allow the shelf (9) to travel along a horizontal trajectory with variable orientation of its positioning, in such a way as to pass through the access opening (3) of said cabinet (1); wherein said control and guiding means (13) comprise two sliders (14) and two tracks (16) relative to which said sliders (14) are movable, said sliders (14) and said tracks (16) being constantly coupled to one another, and operatively positioned between said first arm (5) and second arm (6); and wherein said sliders (14) are coaxial and monolithically connected to each other, being interposed between said two tracks (16) which are on either side and opposite one another.

7. The mechanism according to claim 6, wherein said sliders (14) are supported by the structure of the articulated joint (12) and said tracks (16) are supported by said first arm (5).

8. The mechanism according to claim 7, wherein at least one of said tracks (16) is equipped with closed ends (21, 22), forming the ends of stroke of the motion of the sliders (14) relative to the tracks (16), where the transition takes place between the outward motion and the return motion, and vice versa, of the shelf (9) through the access opening (3) of the cabinet (1).

* * * * *